US006960154B2

(12) United States Patent
Chen

(10) Patent No.: US 6,960,154 B2
(45) Date of Patent: Nov. 1, 2005

(54) REPLACEABLE CONTROL MAINBOARD FOR TREADMILL

(76) Inventor: Jack Chen, No. 35, Tun Hi Rd., Chin Chan Li, Sa Lu Chen, Taichung Hsien (TW)

( * ) Notice: Subject to any disclaimer, the term of this patent is extended or adjusted under 35 U.S.C. 154(b) by 191 days.

(21) Appl. No.: 10/277,737

(22) Filed: Oct. 23, 2002

(65) Prior Publication Data

US 2004/0053746 A1 Mar. 18, 2004

(30) Foreign Application Priority Data

Jul. 4, 2002 (TW) ..... 91210128 U

(51) Int. Cl.[7] ..... A63B 22/00
(52) U.S. Cl. ..... 482/1; 482/8; 482/51; 482/54
(58) Field of Search ..... 482/900–902, 482/1–9, 51, 54

(56) References Cited

U.S. PATENT DOCUMENTS 3,711,812 A * 1/1973 Cherry ..... 338/200
6,572,512 B2 * 6/2003 Anderson et al. ..... 482/51

* cited by examiner

*Primary Examiner*—Glenn E. Richman
(74) *Attorney, Agent, or Firm*—Browdy and Neimark, PLLC

(57) ABSTRACT

A treadmill is installed with a control panel thereon, which includes a control mainboard, an input system, and a display system. The control mainboard is detachably interconnected with the input system and the display system for transmitting a control signal to maneuver the operating speed and other functions of the treadmill such that it has the feature of being easily detached and installed.

4 Claims, 2 Drawing Sheets

REPLACEABLE CONTROL MAINBOARD FOR TREADMILL

FIELD OF THE INVENTION

The present invention relates generally to a treadmill, and more particularly to a replaceable control mainboard for the treadmill.

BACKGROUND OF THE INVENTION

The operating speed and other functions of a conventional treadmill are controlled by a control panel provided by the treadmill, wherein the control panel is composed of a control mainboard, an input system, and a display system. When a user enters a command from the input system, the input system will immediately generate a signal, which will be transmitted to a motor of the treadmill through the control mainboard so as to control the operating speed of the treadmill. In the meantime, the signal will be transmitted to the display system of the treadmill for the user's reference.

However, the control mainboard, the input system and the display system are together fixedly mounted on the control panel of the conventional treadmill to make the control panel function normally. Additionally, the control mainboard is manufactured along with the treadmill and is exclusively made for structurally corresponding to the treadmill. Therefore, the control mainboard of the treadmill cannot be recycled for other types of treadmills. Furthermore, the aforesaid control mainboard is expensive and there are commercially many types of treadmills, which will soon be outdated and deserted. If the control mainboard is exclusively used in one treadmill, once the treadmill is outdated and deserted, the control mainboard will be synchronically deserted and cannot be recycled. As a result, it's wasteful and the production cost of new treadmills will be relatively increased.

SUMMARY OF THE INVENTION

The primary objective of the present invention is to provide a replaceable control mainboard, which is easily replaceable and can be installed on other types of treadmills.

The secondary objective of the present invention is to provide a replaceable control mainboard, which is replaceable to facilitate the jobs of maintaining and repairing the treadmill.

The foregoing objectives of the present invention are attained by the replaceable control mainboard of the treadmill of the present invention. The treadmill is installed with a control panel thereon, which includes the control mainboard, an input system, and a display system. The control mainboard is detachably interconnected with the input system and the display system such that it has the feature of being easily detached and installed. Additionally, the control mainboard is provided for transmitting a control signal to maneuver the operating speed and other functions of the treadmill.

DETAILED DESCRIPTION OF THE INVENTION

Figure 1:
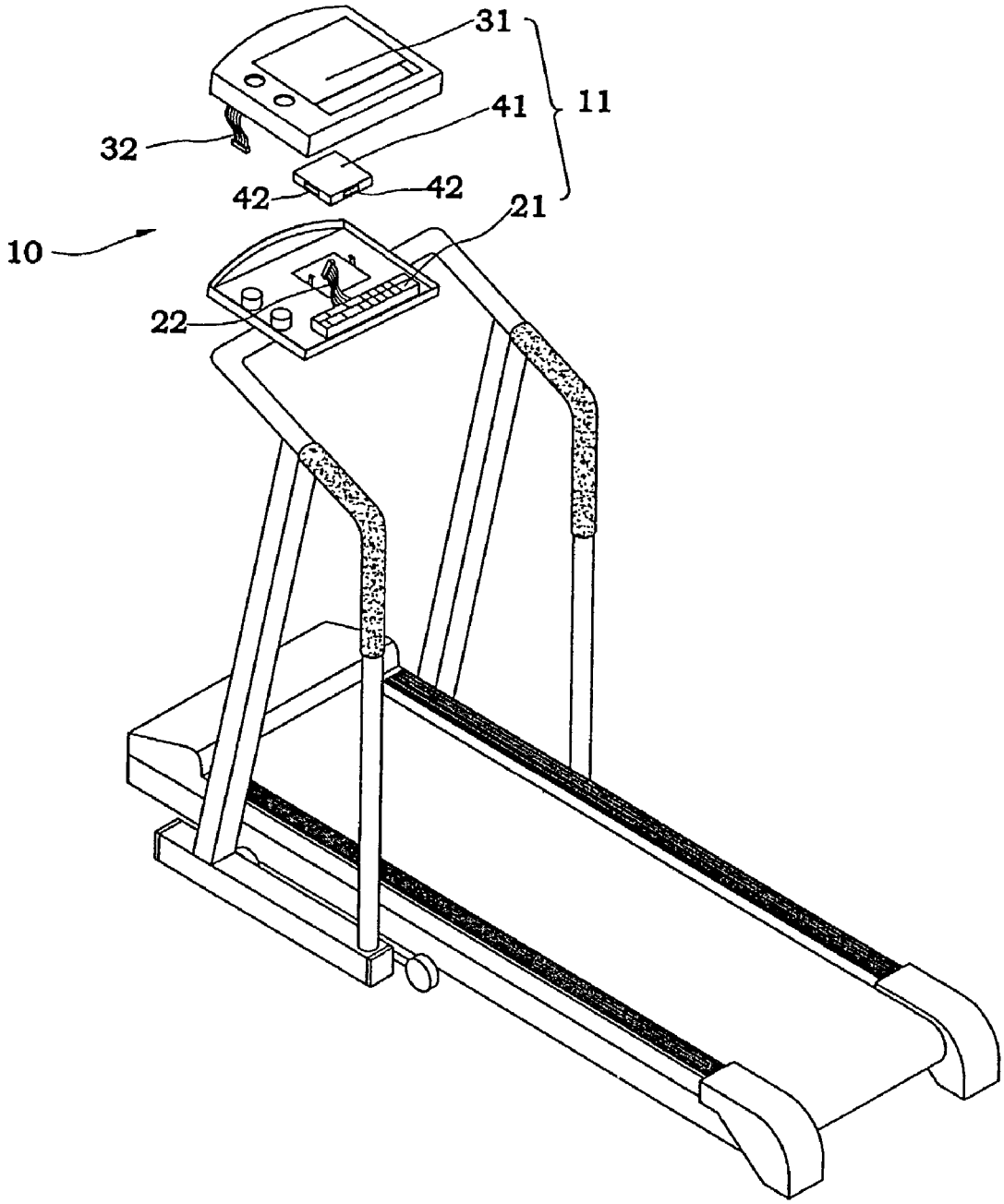
FIG. 1 is a partial exploded view of a preferred embodiment of the present invention.
Figure 2:
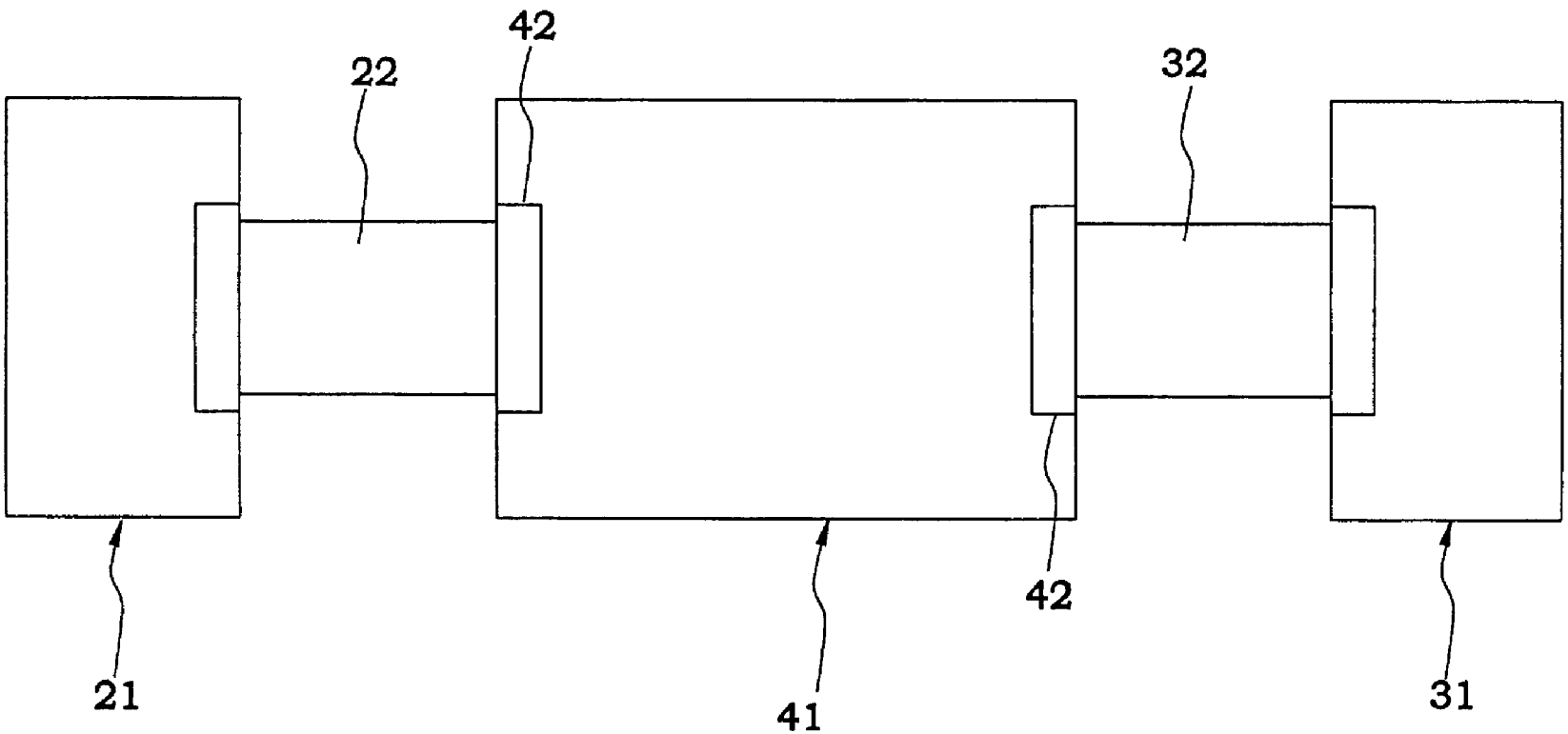
FIG. 2 is a schematic control block chart of the preferred embodiment of the present invention.

Referring to FIGS. 1–2, a treadmill 10 is installed with an electronic control panel 11 thereon. The control panel 11 includes an input system 21, a display system 31, and a replaceable control mainboard 41 installed inside.

The input system 21, which is a set of keypads in this embodiment, is for the user entering appropriate commands and includes an input interface 22.

The display system 31, which is a monitor in this embodiment, shows the operational status for the user's reference and includes a display interface 32. The aforementioned input and display interfaces are respectively composed of a flat cable.

The control mainboard 41 is provided to transmit a control signal to maneuver the operating speed and other functions of the treadmill 10 and includes a plurality of connectors 42, which are detachably interconnected with the input interface 22 and the display interface 32, such that the control panel 11 of the treadmill 10 can normally function.

When the control mainboard 41 is going to be removed from the control panel 11 of the treadmill 10, it needs only to remove the input interface 22 of the input system 21 and the display interface 32 of the display system 31 from the connectors 42 of the control mainboard 41 such that the control mainboard 41 can be successfully detached from the control panel 11 of the treadmill 11.

Accordingly, the present invention is provided with advantages described hereunder:

1. The control mainboard of the present invention is easily replaceable and can be installed to other types of treadmills so as to be recyclable and to avoid wasting resources.

2. The control mainboard of the present invention having the feature of being replaceable makes it easier for maintaining and repairing the treadmill.

What is claimed is:

1. A control mainboard of a treadmill housed within a control panel of the treadmill, wherein said control panel has an input system and a display system engaged thereon;

wherein said control mainboard has a pair of connectors;

wherein said input system and said display system respectively have an input interface and a display interface which are respectively and removably engaged to said pair of connectors;

whereby said control mainboard is detachably interconnected with said input system and said display system of the control panel for transmitting a control signal to maneuver the operating speed of the treadmill.

2. The control mainboard as defined in claim 1, wherein said input system is a set of keypads.

3. The control mainboard as defined in claim 1, wherein said display system is a monitor.

4. The control mainboard as defined in claim 1, wherein each of said two interfaces is a flat cable having a connector on a free end of said flat cable corresponding to each of the pair of connectors on said control mainboard.

* * * * *